United States Patent [19]

Maurer et al.

[11] 4,341,501

[45] Jul. 27, 1982

[54] HYDRAULIC CONTROL VALVE CIRCUIT FOR A SWING MECHANISM

[75] Inventors: Herman J. Maurer; Carl O. Pedersen, both of Burlington, Iowa

[73] Assignee: J. I. Case Company, Racine, Wis.

[21] Appl. No.: 180,311

[22] Filed: Aug. 22, 1980

[51] Int. Cl.[3] ..... B66F 9/22; F15B 11/20; F15B 13/06

[52] U.S. Cl. ..... 414/694; 91/176; 91/188; 91/417 R

[58] Field of Search ..... 414/694, 687; 212/245; 91/176, 188, 210, 417 R

[56] References Cited

U.S. PATENT DOCUMENTS

| | | | |
|---|---|---|---|
| 3,047,171 | 7/1962 | Long | 212/245 X |
| 3,630,120 | 12/1971 | Carlson et al. | 414/694 X |
| 3,757,642 | 9/1973 | Schuermann | 91/176 |
| 3,872,985 | 3/1975 | Short | 414/694 |
| 4,085,855 | 4/1978 | Worback | 414/694 |
| 4,138,928 | 2/1979 | Pilch | 414/694 X |

*Primary Examiner*—Jeffrey V. Nase

*Attorney, Agent, or Firm*—Dressler, Goldsmith, Shore, Sutker & Milnamow, Ltd.

[57] ABSTRACT

A unique hydraulic circuit is provided for converting rectilinear motion to rotational motion about an axis through the use of two pivotally mounted hydraulic motors. The hydraulic motors are pivotally interconnected between a pivoting member and a fixed member. A source of hydraulic fluid under pressure is directed to each hydraulic motor by a conduit system incorporating a flow control valve and a sequencing valve. The flow control valve selectively delivers fluid power to the hydraulic motors to rotate the pivoting member in one direction or the other. The sequencing valve senses the angular position of the two hydraulic motors and redirects the flow of fluid to the hydraulic motors in such a manner as to maintain the torque applied to the pivoting member relatively constant. The sequencing valve acts to redirect the flow of hydraulic fluid to the hydraulic motors so that only one of the hydraulic motors is pressurized at the end of the arc of swing of the pivoting member. The other hydraulic motor, at the beginning of the arc of swing of the pivoting member, has pressure applied to both sides of its piston by the sequencing valve. Both hydraulic motors are pressurized by the sequencing valve to develop their maximum output force when those hydraulic motors are between their overcenter positions.

9 Claims, 12 Drawing Figures

HYDRAULIC CONTROL VALVE CIRCUIT FOR A SWING MECHANISM

TECHNICAL FIELD

This invention relates to the swing mechanism used to pivotally rotate a boom about a vertical axis. In particular, it is related to a new and improved means for controlling the flow of fluid to the double acting fluid rams typically used to rotate the swing tower to which the boom is joined.

BACKGROUND OF THE INVENTION

Many implements used in material handling and in civil engineering applications have members which are pivotally moved by fluid actuated hydraulic motors or fluid rams. The boom support or swing tower carrying the boom and dipper stick of a backhoe is a typical example. There, a pair of hydraulic motor or fluid rams are used to pivot the swing tower with respect to a fixed support frame or stand. The support frame is usually carried at the rear end of a tractor or similar machine. In such a device the hydraulic motors are ordinarily connected to the swing tower on opposite sides of the vertical pivot axis between the swing tower and the fixed support frame. Thus, when the swing tower is rotated, one of the cylinders initially contracts and the other extends in order to rotate the swing tower. Since the arc through which the swing tower rotates is at least 180 degrees, one of the hydraulic motors applies the primary force to rotate the boom to one side of its midpoint in the arc of rotation while the other hydraulic motor applies the primary force to rotate the boom in the other direction from the midpoint of the arc of rotation.

Simple as the task may be of rotating the swing tower, this problem has confounded engineers and designers of material handling equipment from the very beginning. If the hydraulic motors could be positioned facing each other on either side of the midplane of rotation, each hydraulic motor would apply an equal force across an equal distance to produce an equal moment arm to torque the swing tower about its vertical axis. Because of the spacial limitations imposed upon designers of material handling equipment, both hydraulic motors must be positioned generally parallel to one another. Consequently, in the course of rotating the swing tower from one extreme to the other, each hydraulic motor passes through the plane defined by the vertical axis of rotation of the swing tower and the axis of rotation of that element (i.e., cylinder or piston rod) pivotally connected to the fixed frame supporting the swing tower. Thus, two vertical planes are defined having a common intersection at the pivot axis of the swing tower.

When rotating the swing tower from one extreme to the other, one of the hydraulic motors is driven from a fully contracted position to a fully extended position. The fully extended position occurs when the plane defined by the two pivot axes of the hydraulic motor passes through the vertical axis of rotation of the swing tower. If the swing tower is to continue to rotate, that hydraulic motor must contract in length. When the vertical plane defined by the two pivot axes of the hydraulic motor passes through the vertical axis of rotation of the swing tower, the hydraulic motor is used to pass through its "overcenter position."

Many designers have struggled with this problem. The teachings of J. S. Pilch (U.S. Pat. No. 4,138,928) and E. C. Carlson (U.S. Pat. No. 3,630,120) relate the difficulty in converting rectilinear motion to rotational motion. J. S. Pilch and D. L. Worbach (U.S. Pat. No. 4,085,855) are representative of situations where the same inventor has progressed through a series of patents attempting to reach an optimum solution to this problem. An excellent description of the mechanical aspects of the problem is provided by Arthur G. Short in U.S. Pat. No. 3,872,985.

Thus, there is a long-felt need for a hydraulic circuit which will rotate the swing tower uniformly by the relatively constant application of torque throughout its swing. A simplified, efficient system would be particularly welcomed by the industry.

SUMMARY OF THE INVENTION

In accordance with the present invention a hydraulic circuit is provided for rotating a movable member through an arc by the conversion of rectilinear motion to rotational motion in such a manner that a relatively uniform torque is applied to the rotational member throughout the swing. Specifically, and with reference to a backhoe application, two hydraulic motors are used to rotate the swing tower or the bracket supporting the boom about a vertical axis. The swing tower is pivoted about a vertical axis on a fixed support stand or frame. The support stand is in turn attached to a tractor. The hydraulic motors are pivoted at one end to the support stand and at the other end to the swing tower. The hydraulic power supply on the tractor supplies fluid under pressure to actuate the hydraulic motors. A flow control valve directs fluid under pressure to the hydraulic motors to rotate the swing tower. The flow control valve directs pressurized fluid directly to one end of one of the two hydraulic motors and determines the direction of swing. A sequencing valve is interposed between the two ends of the two hydraulic motors. The sequencing valve directs the pressurized fluid from the control valve to the other ends of the two hydraulic motors in such a manner that a pressure differential is first created across one of the hydraulic motors, and then both of the hydraulic motors, and finally across the other hydraulic motor. The sequencing valve shifts positions as the hydraulic motors pass through their over center positions in rotating the swing tower from one extreme position to another. At the beginning of the swing, pressurized fluid is directed to three of the four sides of the two pistons in the two hydraulic motors so that one motor develops its maximum output force while the other motor develops a reduced output force. At the end of the swing, pressurized fluid is directed to only one of the four sides of the two pistons in the two hydraulic motors, so that only one motor develops its maximum output force to rotate the swing tower. The other hydraulic motor is isolated from high pressure fluid. When the swing tower is between the over center positions of each motor, pressurized fluid is directed to two of the four sides so that both motors are fully pressurized to rotate the swing tower. Consequently, a relatively uniform torque is applied to the swing tower and the boom throughout their arc of rotation.

Numerous other advantages and features of the present invention will become readily apparent from the following detailed description of the invention and of the one embodiment described therein, from the claims and from the accompanying drawings.

Figure 1:
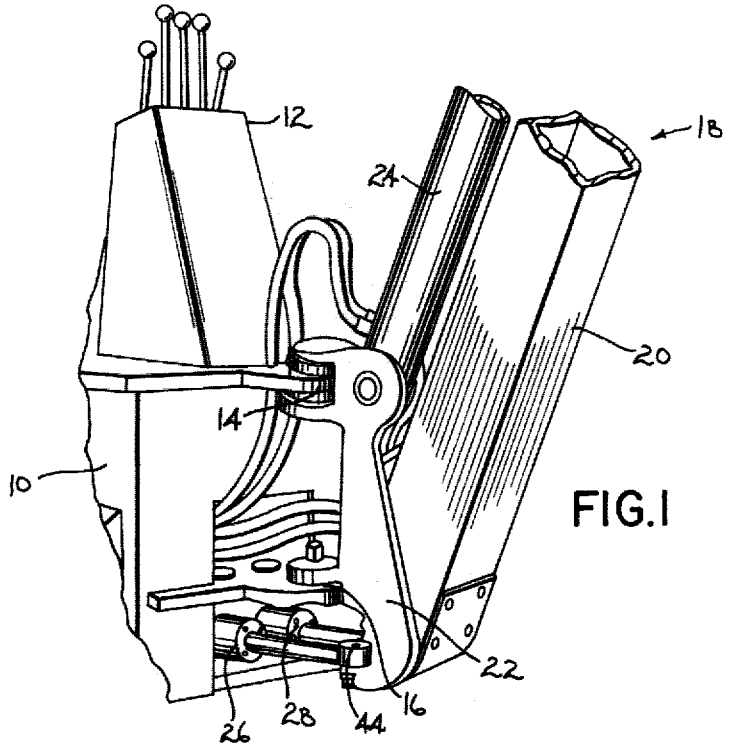
FIG. 1 is a perspective view of a backhoe showing the relative position of the two hydraulic motors used to rotate the backhoe boom about a vertical axis.
Figure 3:
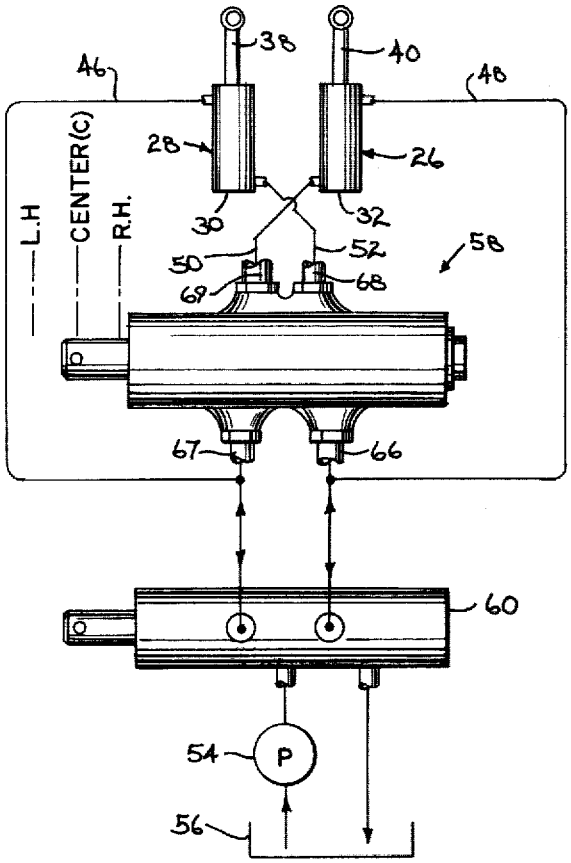
FIG. 3 is a schematic diagram of the hydraulic circuit used to operate the hydraulic motors shown in FIG. 1.

FIG's. 4A, 4B, and 4C show the operation of one embodiment of the sequencing valve, shown in FIG. 3, when the boom, shown in FIG. 1, rotates from right to left;

FIG's. 5A, 5B, and 5C show the operation of one embodiment of the sequencing valve, shown in FIG. 3, when the boom, shown in FIG. 1, rotates from left to right; and FIG's. 6A, 6B, and 6C are diagrammatic plan views showing the relationship of the hydraulic motors and the swing tower as the boom is rotated from left to right.

DETAILED DESCRIPTION

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the specific embodiment illustrated.

OPERATIONAL FUNDAMENTALS

Referring to the drawings, FIG. 1 illustrates a partial view of a fixed support frame or stand 10 which is typically mounted on a tractor (not shown). The support stand 10 includes a control station 12 where an operator is stationed to selectively position various control valves to apply hydraulic fluid under pressure to one or more hydraulic motors to operate the various components of the implement to which the support stand 10 is attached. This support stand 10 includes a pair of vertical pivots 14 and 16 on which the implement 18 to be rotated is mounted. For illustrative purposes, the implement 18 is the swing tower 22 and boom 20 of a backhoe; although it should be understood that the present invention is applicable to other implements and other structures and machines such as, for example, articulated steering systems.

In the case of a typical backhoe, the boom 20 is pivotally mounted in a boom support or swing tower 22 for movement about a vertical axis. The swing tower 22 is pivotally supported on the two vertical pivots 14 and 16 for lateral rotation.

The boom 20 is raised and lowered by the application of hydraulic pressure to either end of a double acting hydraulic motor or ram 24 and is rotated laterally by the selective application of hydraulic pressure to a pair of hydraulic motors 26 and 28 pivotally connected at one of their ends to the swing tower 22 on opposite sides of the vertical axis of the vertical pivots 14 and 16. The other end of each hydraulic motor 26, 28 is pivotally connected to the support stand or frame 10.

Figure 6A:
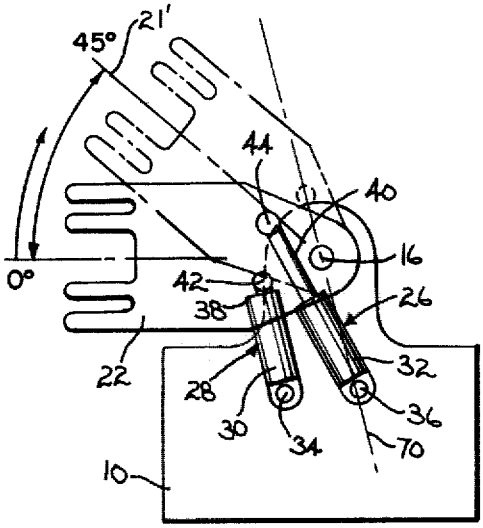
Figure 6B:
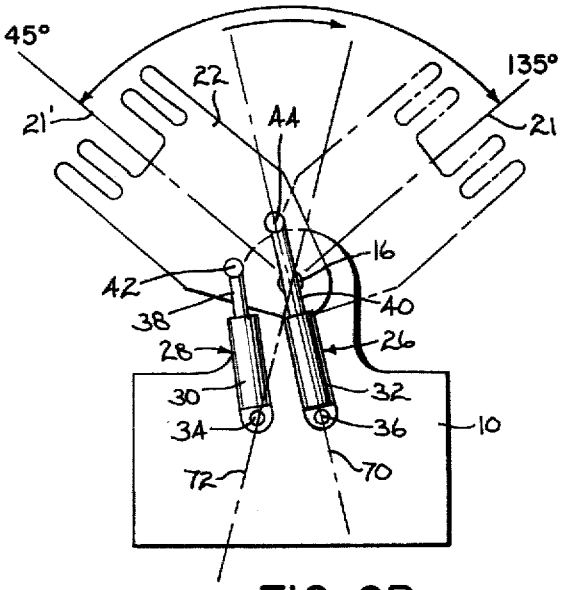
Figure 6C:
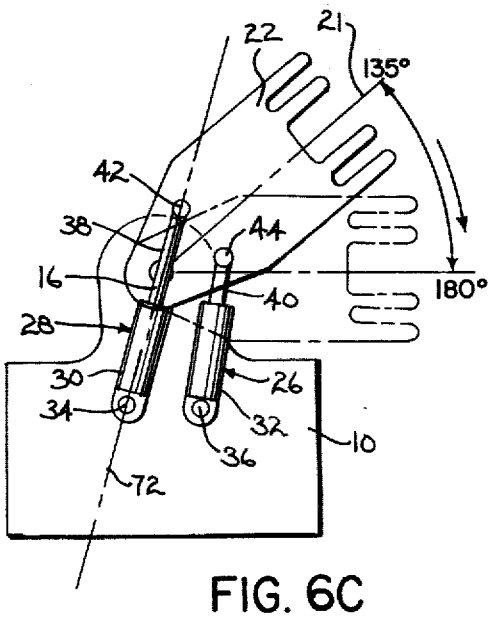

Each hydraulic motor 26, 28 (as can be seen clearly in FIG. 6) includes a hydraulic cylinder 30, 32 pivotally mounted at its end 34, 36 to the frame 10. The piston rod 38, 40 in each hydraulic motor 26, 28 is pivotally connected to the swing tower 22 by a pin 42, 44.

The basic hydraulic circuit will now be described. Referring to FIG. 3, hydraulic conduits 46, 48, 50 and 52 are connected to each end of the two hydraulic cylinders 30 and 32 to supply fluid under pressure thereto. In the case of a backhoe mounted on a tractor, the tractor hydraulic system provides the fluid under pressure to actuate the various components of the backhoe. The tractor's hydraulic system typically includes a pump 54 to supply fluid under pressure and a reservoir 56 to collect the fluid displaced by the actuation of the hydraulic motors. A manually actuated valve 60 controls the direction of flow of the pressurized fluid supplied by the pump 54 in the two hydraulic motors 26 and 28. Specifically, the control valve 60 applies fluid under pressure to one of the two hydraulic motors while providing a discharge path from the other hydraulic motor to the reservoir 56. A sequencing valve 58 is interposed between the two ends of the two hydraulic cylinders 30 and 32. The sequencing valve 58 changes position in response to the lateral position of the boom 20 relative to the fixed support frame 10. As will be described in greater detail below, the sequencing valve 58 has three positions; a right hand position (R.H.); a center position (C); and a left hand (L.H.) position. As each hydraulic motor 26, 28 passes across the pivot axis of the swing tower 22, the sequencing valve 58 changes position. Further details of the operation of the control valve 60 and the associated hydraulic system is described by Long in U.S. Pat. No. 3,047,171 (assigned to the assignee of the present invention). Those teachings of Long which are not inconsistent with this disclosure and which relate to the operation of the flow control valve 60 and the hydraulic system supplying fluid thereto are incorporated herein by reference.

Referring to FIG's. 6A, 6B, and 6C, it can be seen that when the swing tower 22 is to be moved from the left to the right (clockwise in the drawings) hydraulic pressure must be applied to the right hydraulic motor 26 and the left hydraulic motor 28 to drive the piston rods 38 and 40 outwardly. With hydraulic fluid thus applied, the boom 20 is rotated clockwise in response to the torque supplied by both hydraulic motors 26 and 28 until a point is reached where the moment arm of the right-hand hydraulic motor 26 decreases to zero. This point is reached when the piston rod 40 of the right-hand hydraulic motor 26 crosses the lower vertical pivot 16 of the swing tower 22 (See FIG. 6B).

If rotation of the swing tower 22 were to be continued without changing the line up of hydraulic fluid flowing under pressure to the two hydraulic motors 26 and 28, it can be seen from the drawings that the hydraulic pressure that was initially applied to the right-hand hydraulic motor 26 will oppose continued clockwise rotation. In effect, the right-hand hydraulic motor 26 applies a "negative torque" to the swing tower 22 after that motor passes through its overcenter position (center line 70).

In the specific arrangement illustrated in FIG's. 6A, 6B, and 6C, an overcenter position of the right-hand hydraulic motor 26 is symbolized in the drawings by a center line 70. The overcenter position of the left-hand hydraulic motor 28 is symbolized in the drawings by a center line 72. Coincidentally, each overcenter position 70, 72 is reached when the swing tower 22 has been rotated through 45 degrees of arc from either the right-hand or left-hand extreme positions (center lines 21 and 21').

Similarly, when the boom 20 is rotated to the left, the left-hand hydraulic motor 28 applies the primary force to rotate the swing tower 22 to the left with sufficient torque to overcome the opposition of the right-hand hydraulic motor 26 as it crosses the vertical pivotal connection 16 and begins to exert an opposing force. Although the force markedly decreases as the swing tower 22 approaches its extreme left-hand position, the increased moment arm of the left-hand hydraulic actuator 28 overcomes the opposition of the right-hand hydraulic motor 26.

Figure 2:
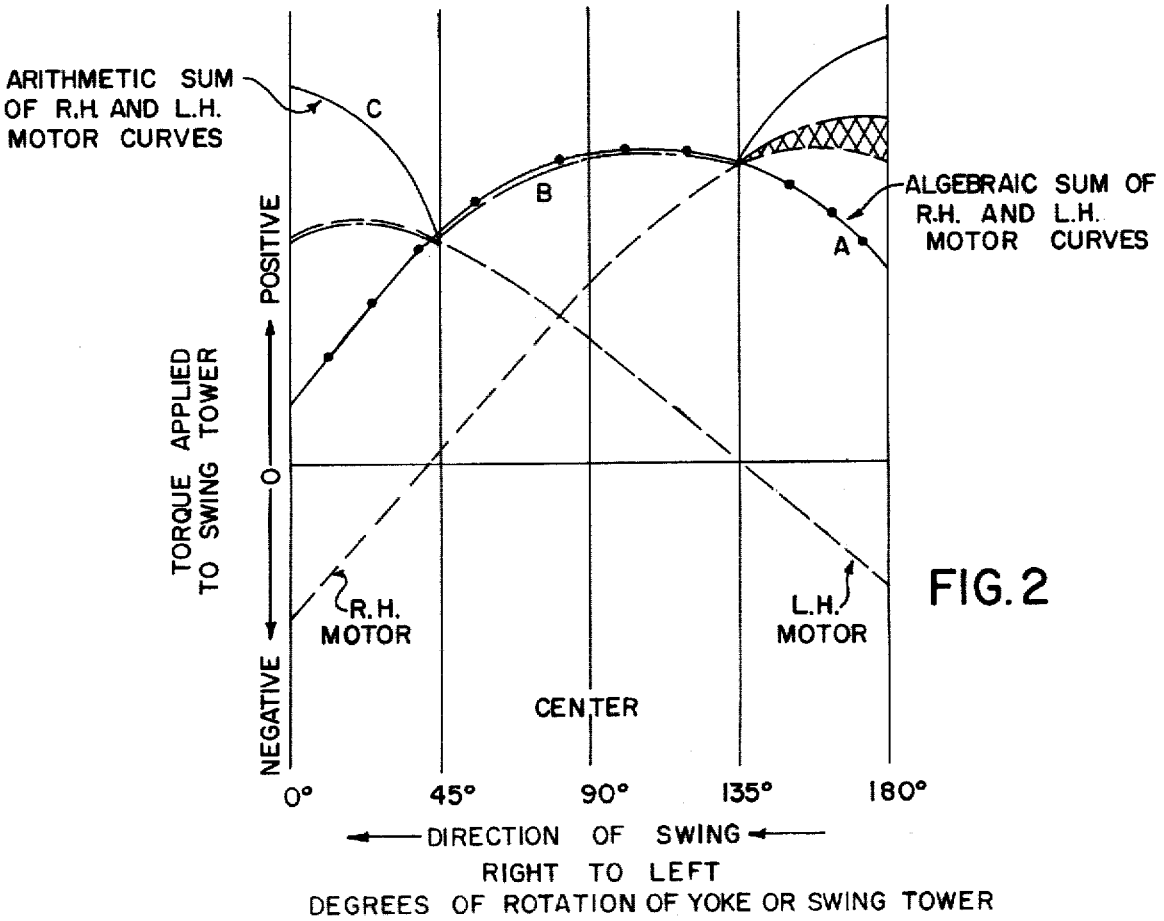
FIG. 2 is a chart depicting the effective torque supplied to the mechanism illustrated in FIG. 1 in rotating it from one side to the other.

FIG. 2 is a plot of the torque applied to the swing tower 22 as a function of the amount of rotation of the swing tower 22 in swinging the boom 20 from the right to the left. "Curve A" is a response curve obtained by the algebraic sum of the right-hand and left-hand hydraulic motors 26 and 28. This curve shows that the net applied torque to the swing tower 22 is a variable quantity dependent upon the angular position of the swing tower. Ideally, this curve should be as "flat" as possible. If this were the case, a relatively "uniform" torque would be applied to the swing tower 22 to rotate the boom 20. The uniform applicaton of torque to the swing tower 22 would rotate the boom at a uniform speed throughout its rotation.

From FIG. 2, it should be apparent that if the negative or opposing torque contributions of each hydraulic motor 26, 28 could be removed or negated at the ends of the arc of rotation of the swing tower, a smoother, flater response curve would result. Specifically, this is illustrated in FIG. 2. by "Curve B." That curve, between zero degrees and forty-five degrees is simply the algebraic sum of the right-hand and left-hand hydraulic motor curves without the right-hand hydraulic motor's 26 negative torque contribution. Mechanically, this characteristic is obtained by pressurizing only the left-hand motor 26 during the last forty-five degrees of rotation. The same approach could be taken to the left-hand hydraulic motor 26 at the beginning of the rotation of the swing tower. However, it is precisely at this time that the greatest torque should be applied to the swing tower to overcome its inertia and thereby getting it to move. This effect is achieved by the sequencing valve 58 and the hydraulic circuit that are the subject of the present invention.

Therefore, instead of redirecting the hydraulic fluid so that only the left-hand hydraulic motor 28 is pressurized to rotate the swing tower clockwise (or left to right), an enhanced or boosted torque to overcome the inertia of the swing tower can be achieved by pressurizing both sides of the right-hand hydraulic motor 26. Those skilled in the art will realize that to rotate the swing tower in the opposite direction involves reversing the flow of fluid across the left-hand hydraulic motor 28 and pressurizing the cylinder side of the right-hand hydraulic motor 26. This, however, would provide too large a torque on the swing tower to the effect that the torque characteristic curve would be very high or skewed at one end and relatively low at the other end which would only create another problem and which would result in a relatively irratic and non-uniform rate of rotation. The non-obvious and highly innovative approach to the problem thus presented is simply to apply hydraulic pressure to both sides of thw right-hand hydraulic motor 26! Since the area of the piston on the cylinder end of the hydraulic motor is greater than the area of the piston on the piston rod side of the hydraulic motor, the right-hand hydraulic motor 26 assists the left-hand hydraulic motor in rotating the swing tower without abruptly changing the torque over that situation where only the left-hand hydraulic motor is pressurized. Furthermore, since the direction of flow of fluid across the cylinder that is pressurized on one side can be changed simply by repositioning the manually actuated control valve 60, the sequencing valve that was used to cut-off high-pressure fluid from the cylinder or head side of the piston in the right-hand hydraulic motor 26 can then be used to pressurize both sides of the right-hand hydraulic motor. This realization or act of inventive insight greatly simplifies the "valving" needed to redirect the flow of fluid to both hydraulic motors in rotating the swing tower first in one direction and then in the other direction. This will become quite clear from the detailed discussion following.

Recapitulating, in order to flatten the torque characteristic curve and to improve the operator's control of the swing tower when rotating it from one extreme to the other, the sequencing valve: (1) cuts off the flow of pressurized fluid to that hydraulic motor having just passed through its overcenter position; (2) pressurizes both sides of one hydraulic motor (the one having last passed through its overcenter position) and one side of the other hydraulic motor at the beginning of the arc of rotation of the swing tower; and (3) pressurizes opposite sides of the pistons in both hydraulic motors when both hydraulic motors are between their overcenter positions (i.e., at the mid-point of the arc of rotation).

For purposes of comparison, "Curve C" illustrates the response characteristic obtained by adding the two individual hydraulic motor curves arithmetically. One practitioner, E. C. Carlson, (U.S. Pat. No. 3,630,120) teaches a hydraulic circuit that uses two sequencing valves to decelerate the boom structure by applying an opposing torque at either end of the swing of the boom.

It should be noted that because the two sides of the piston in each hydraulic motor 26, 28 are of unequal area (due to the piston rod), the force applied by the piston rod of the hydraulic motor in moving in one direction is not equal to the force when the piston is moving in the opposite direction. This accounts for the asymmetry of the torque characteristic curves or response curves of the right hand and left hand motors. Moreover, since both sides of one of the hydraulic motors (the right-hand one in FIG. 2) are pressurized at the beginning of rotation (e.g., 180 degrees to 135 degrees), the torque produced from that motor enhances or adds to the torque produced by the other motor (See shaded area on FIG. 2 between Curve B and the R.H. Motor Curve). The force produced when both sides of one piston are fully pressurized is approximately equal to the area of the piston rod multiplied by the pressure of the high pressure hydraulic fluid.

DETAILS OF OPERATION

The details of the sequencing valve 58 are illustrated in FIG's. 4A, 4B, and 4C. The sequencing valve 58 has two main parts: a valve body 62 and a valve spool 74. The valve body 62 has a generally axial bore 64 extending therethrough with four valve ports 66, 67, 68 and 69 surrounding the bore 64 at points intermediate the two ends of the valve body 62.

Two valve ports 68 and 69 are joined to the same corresponding end of the two hydraulic motors 26 and 28 and the other two valve ports 66 and 67 are joined to the other corresponding end of the two hydraulic motors. In particular, two valve ports 68 and 69 are in flow communication with the cylinder end of the two hydraulic motors 26 and 28 while the other two valve ports 66 and 67 are in flow communication with the piston rod end of the two hydraulic motors 26 and 28.

The valve spool 74 of the sequencing valve 58 has two recessed portions 76 and 78 disposed intermediate its ends. A circumferential land 80 separates the two recessed portions 76, 78. The valve spool 74 is slidably mounted in the bore 64 of the valve body 62. Conventional seals 82 and 84 seal the annular zone between the bore 64 of the valve body 62 and the outside periphery of the valve spool 74 at each end of the valve body. One end of the valve spool 74 has an aperture 53 suitable for use in joining the spool to the device 83 that is used to stroke or reposition the valve spool in the valve body 62. In addition, a circumferential ring 81 is provided to limit the motion of the valve spool 74 in moving from the right to the left.

The valve spool 74 can be moved or repositioned within the valve body 62 by any one of several well-known devices 83. For example, a follower riding on a cam keyed to the swing tower 22 can be used to change or reposition the valve spool 74. U.S. Pat. No. 3,872,985 to Short, and assigned to the assignee of the present invention, describes such a valve positioning device 83. Those teachings by Short as related to a cam and follower used to position the valve spool 74 are herein incorporated by reference.

The valve spool 73 has three positions in the valve body 62. Those positions are illustrated in FIG. 3 and are designated as the "right-hand" position (R.H.), the "center position" (C) and the "left-hand" position (L.H.). The center position C is illustrated in FIG's. 4B and 5B. In the center position valve port 66 is aligned with valve port 68 and valve port 67 is aligned with valve port 69. Consequently, when the sequencing valve 58 is in its center position C and the flow control valve 60 is actuated, high pressure fluid is applied to two of the four inlet ports in the two hydraulic motors 26, 28 (ports 50 and 46 in FIG. 4B and ports 48 and 52 in FIG. 5B).

Figure 4A:
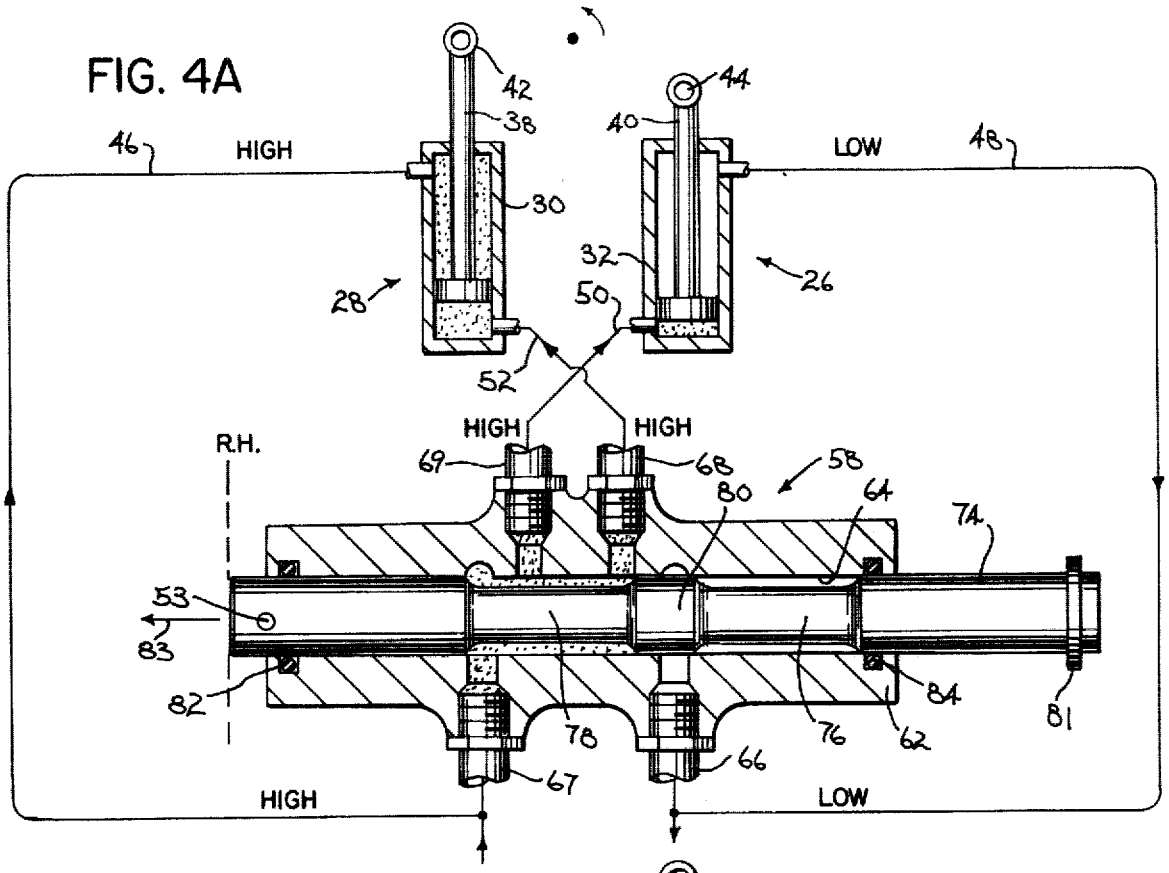
Figure 5A:
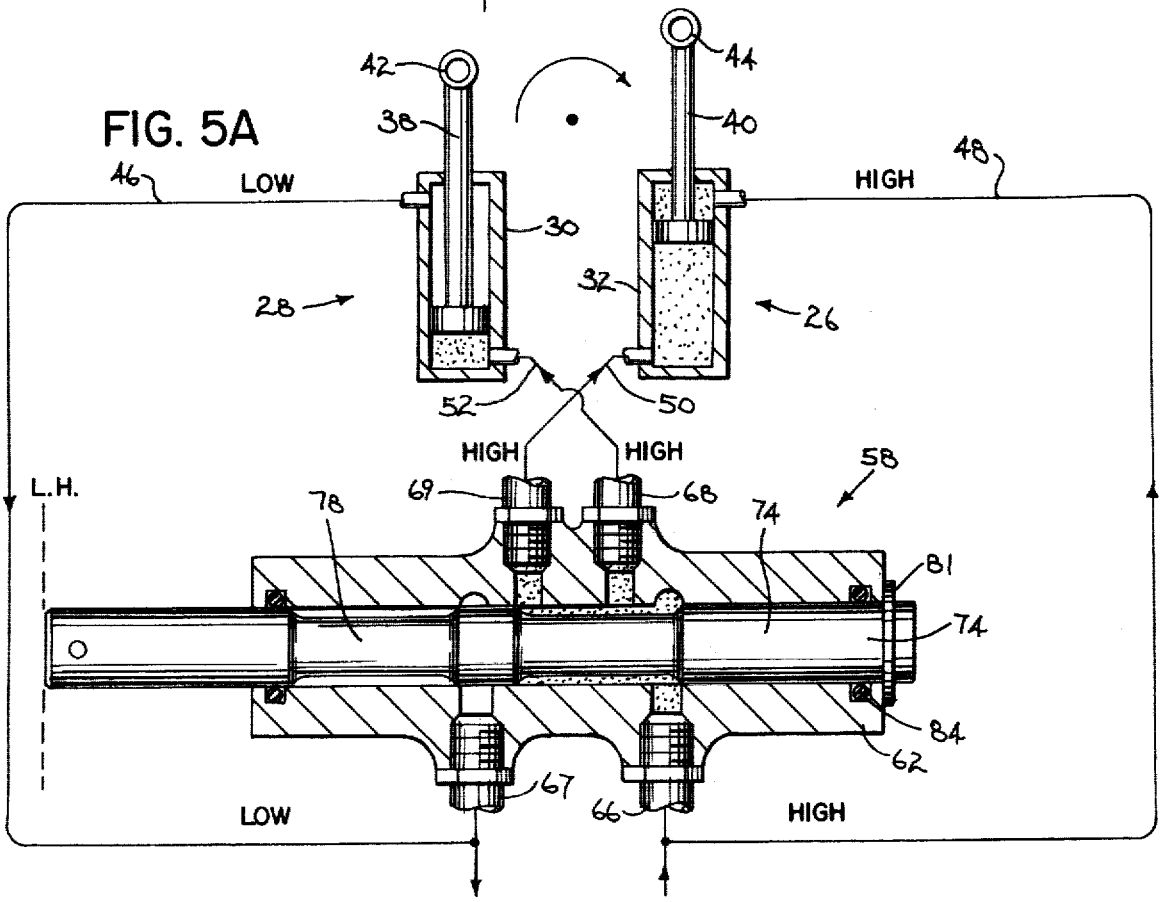

When the sequencing valve 58 is in the right-hand position R.H. (see FIG.'s. 4A and 5C), high pressure fluid is applied to three 46, 50, 52 of the four valve ports in the two hydraulic motors 26 and 28 in rotating the swing tower 22 from the right to the left (FIG. 4A) and to only one 48 of the four valve ports in rotating the swing tower from the left to the right (FIG. 5C). In each case, when the sequencing valve 58 is in its right-hand position R.H., three of the four valve ports in the valve body 62 of the sequencing valve 58 are joined together. In each case, the two valve ports 68 and 69 joined to the cylinder end of the two hydraulic motors 26 and 28 are joined together.

When the sequencing valve is in the left-hand position L.H. (see FIG.'s. 4C and 5A) three of the four valve ports in the sequencing valve are joined together. Specifically, the two valve ports 68 and 69 joined to the cylinder end of each of the two hydraulic motors 26 and 28 are joined together with the piston rod end of the right-hand hydraulic motor 26. In particular, when the swing tower 22 is rotated from the right to the left (see FIG. 4C), the two cylinder ends of the two hydraulic motors 26 and 28 are joined to the low pressure side of the flow control valve 60. In rotating the swing tower 22 from the left to the right (see FIG. 5A), the cylinder ends of the two hydraulic motors 26 and 28 are joined to the high pressure side of the flow control valve 60.

It will be observed from the foregoing that when the sequencing valve 58 is in its center position C (see FIG.'s. 4B and 5B) hydraulic fluid is applied under pressure to opposite sides of the two hydraulic motors 26 and 28. In other words, one of the two hydraulic motors is ported so as to drive the piston rod outwardly while the other hydraulic motor is ported to drive the piston rod inwardly. In addition, when the sequencing valve 58 is either in the right hand R.H. or left hand L.H. position, one of the two hydraulic motors 26 and 28 (the one having just passed through its overcenter position) is isolated from the high pressure side of the hydraulic control valve 60 if the rotation of the swing tower is continued in a direction away from that same overcenter position. That hydraulic motor then does not oppose the torque produced by the other hydraulic motor. However, if the rotation of the swing tower is reversed (i.e., the position of the flow control valve is changed), both sides of the piston of that hydraulic motor are pressurized. When so pressurized that hydraulic motor boosts or assists the other hydraulic motor in rotating the swing tower towards the overcenter position of that hydraulic motor.

The integrated operation of the sequencing valve 58, the associated hydraulic motors 26 and 28 and the flow control valve 60 will now be described. FIG.'s. 4A, 4B and 4C illustrate the position of the sequencing valve 58 and the two hydraulic motors 26, 28 in rotating the swing tower 22 from the extreme right-hand position to the extreme left-hand position (counterclockwise when viewed from above). When the swing tower 22 is in its extreme right-hand position, the valve spool 74 of the sequencing valve 58 is in its right-hand position R.H. (see FIG. 4A). To rotate the swing tower 22 from the right to the left the flow control valve 60 is manipulated to pressurize the piston rod end of the left-hand hydraulic motor 28 and the associated valve port 67 of the sequencing valve 58 joined to the piston rod end of the left-hand hydraulic motor. The valve port 66 joined to the piston rod end of the right-hand hydraulic motor 26 is aligned to the low pressure side of the flow control valve 60.

With flow applied to these ports and with the valve spool 74 in the right hand position R.H., the left-hand hydraulic motor 28 has high pressure fluid applied to both sides of its piston. On the other hand, the right-hand hydraulic motor 26 has high pressure fluid applied to its cylinder side while the piston rod side of the right-hand hydraulic motor is connected to the reservoir 56. With the fluid thus ported, the output force of the left-hand hydraulic motor 28 is reduced over that of a hydraulic motor to which pressure is applied only to the cylinder or head side of the piston. This is because the same pressure is on both sides of the piston. The right-hand hydraulic motor 26, on the other hand, develops its full output force because high pressure fluid is directed to only its cylinder side. Thus, both hydraulic motors produce a positive torque inducing the swing tower 22 to rotate counterclockwise.

Figure 4C:
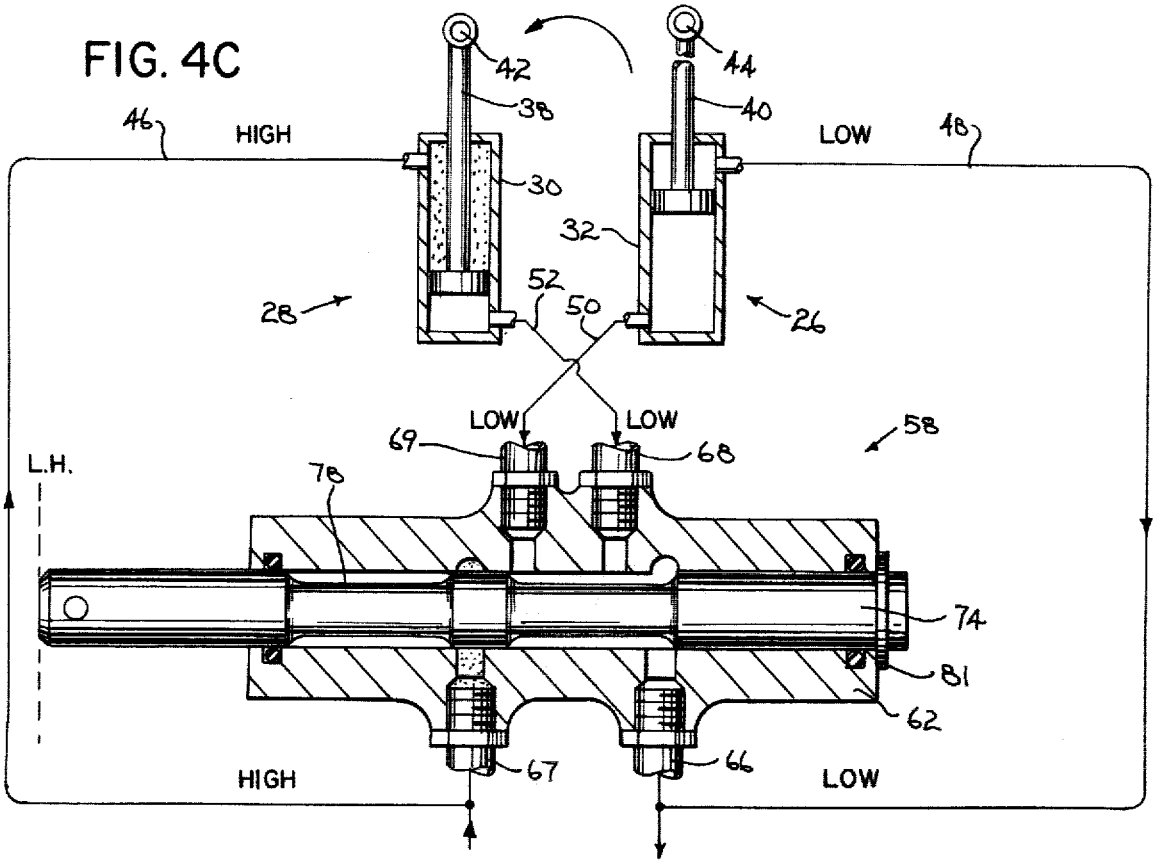
Figure 4B:
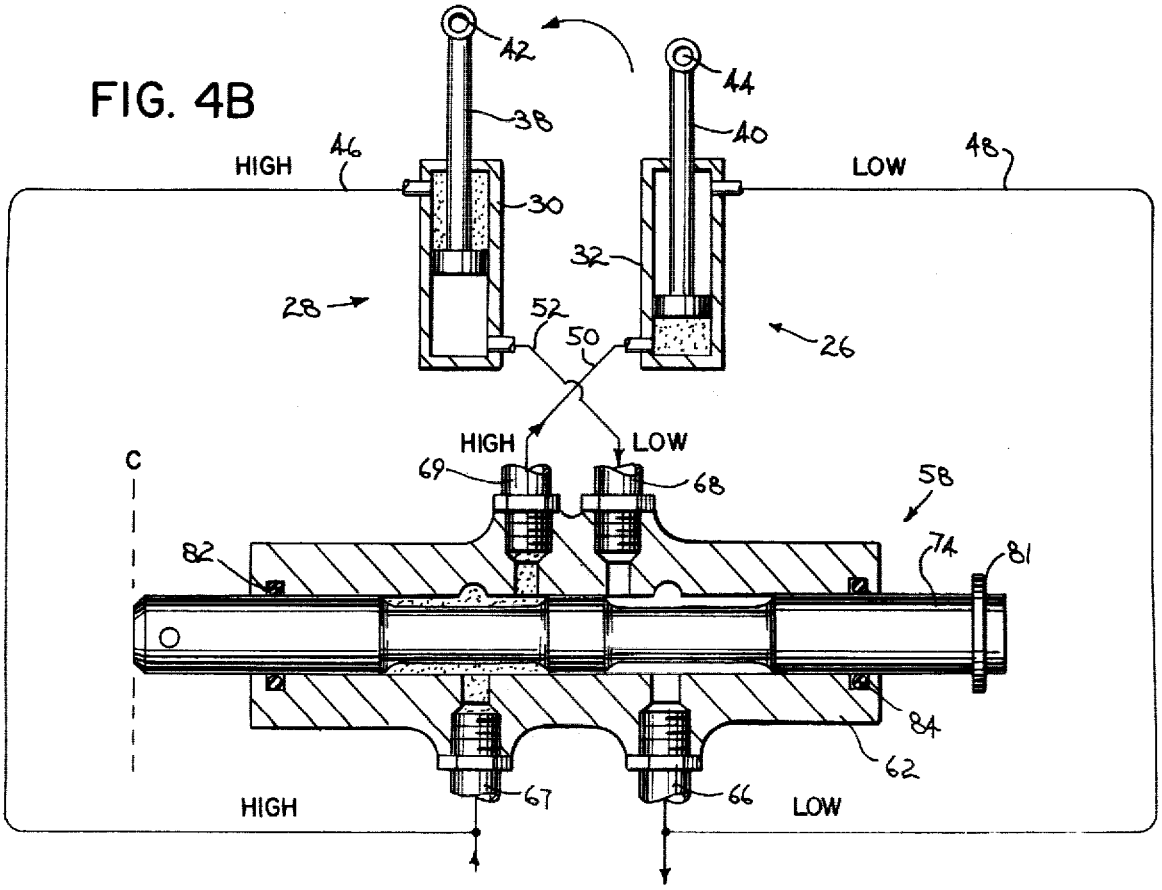

Once the left-hand hydraulic motor 28 has passed through its overcenter position (center line 72 in FIG. 6C) the sequencing valve 58 is shifted to its center position C (see FIG. 4B). As before, high pressure fluid is still applied to valve port 67 joined to the piston rod end of the left-hand hydraulic motor 28. With the shifting of the valve spool 74 of the sequencing valve 58, high pressure fluid is cut off from the cylinder side of the left-hand hydraulic motor 28 and the cylinder side of the left-hand hydraulic motor is ported to the reservoir 56. When the sequencing valve 58 is in its center position C, high pressure fluid is ported to the piston rod side of the left-hand hydraulic motor 28 and to the cylinder side of the right-hand hydraulic motor 26; consequently, the piston rod 38 of the left-hand hydraulic motor 28 is driven inwardly while the piston rod 40 of the right-hand hydraulic motor 26 is driven outwardly. This serves to rotate the swing tower 22 counterclockwise. Once the swing tower 22 has been rotated so far to the left that the right-hand hydraulic motor 26 passes through its overcenter position (see center line 70, FIG. 6B) then the sequencing valve 58 is shifted to the left-hand position L.H. (See FIG. 4C).

When the sequencing valve 58 is in its left-hand position L.H., high pressure fluid is directed to only the left-hand hydraulic motor 28. Specifically, and referring to FIG. 4C, when the valve spool 74 of the sequencing valve 58 shifts from the center position C to the left-hand position L.H., high pressure fluid is shut off from the cylinder side of the right-hand hydraulic motor 26 and the cylinder side of the right-hand hydraulic motor is ported to the reservoir 56. When thus ported, the right-hand hydraulic motor 26 cannot oppose the torque produced by the fully pressurized left-hand hydraulic motor. The left-hand hydraulic motor 28 is ported to drive its piston rod 38 inwardly. Once the swing tower 22 has been driven to its extreme left-hand position or the piston in the left-hand hydraulic motor 28 bottoms the rotation of the boom 20 stops.

Should it then be desired to rotate the boom 20 from the extreme left-hand position to the right-hand position (i.e. clockwise), all that is needed is for the operator to manipulate the controls 12 (see FIG. 1) to reposition the flow control valve 60 to reverse the flow of high pressure fluid. When this is done, the swing tower 22 can be rotated from the left to the right; this is illustrated in FIG.'s. 5A, 5B and 5C. It should be noted that the mechanical position of the components shown in FIG. 5A is identical to the position of the components as illustrated in FIG. 4C. All that flow control valve 60 does is reverse the flow of fluid. As discussed previously, the particular advantage of this scheme is that the sequencing valve does not have to be repositioned while the hydraulic motor, which was previously isolated from the high pressure side of the hydraulic control valve 60, can be used (by pressurizing both sides of its piston) to increase the torque applied to the swing tower in overcoming the swing tower's inertia and causing it to rotate in the opposite direction. This is a feature not otherwise found in conventional hydraulic control systems.

Specifically, and referring to FIG. 5A, high pressure fluid is ported to the piston rod side of the right-hand hydraulic motor 26 and to the cylinder sides of both the right-hand hydraulic motor 26 and the left-hand hydraulic motor 28. Since the piston rod side of the left-hand hydraulic motor 28 is ported to the reservoir 56, the left-hand hydraulic motor 28 develops its maximum output force in driving its piston rod 38 outwardly. On the other hand, the right-hand hydraulic motor 26 develops a reduced output force to drive its piston rod outwardly. Consequently, the swing tower 22 is driven clockwise by the left-hand hydraulic motor 28 with the assistance of the right-hand hydraulic motor 26.

Figure 5B:
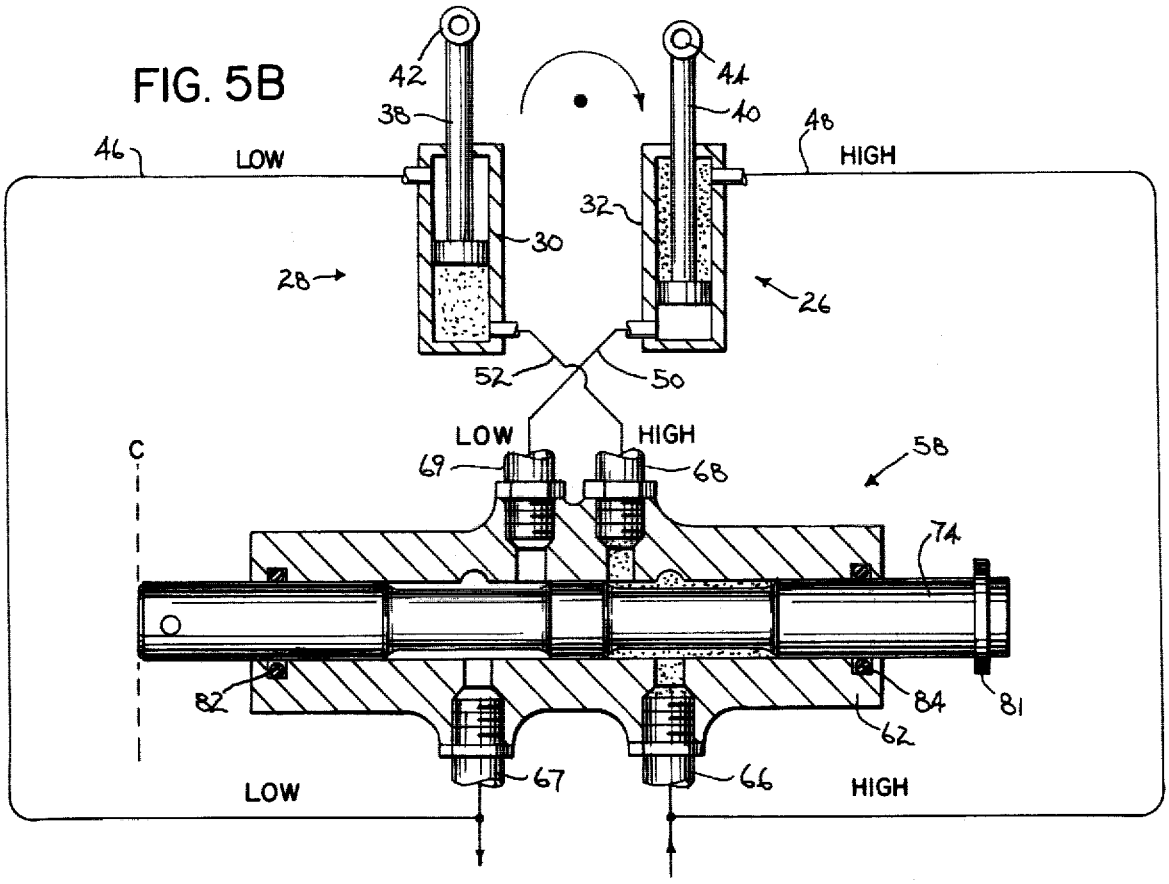
Figure 5C:
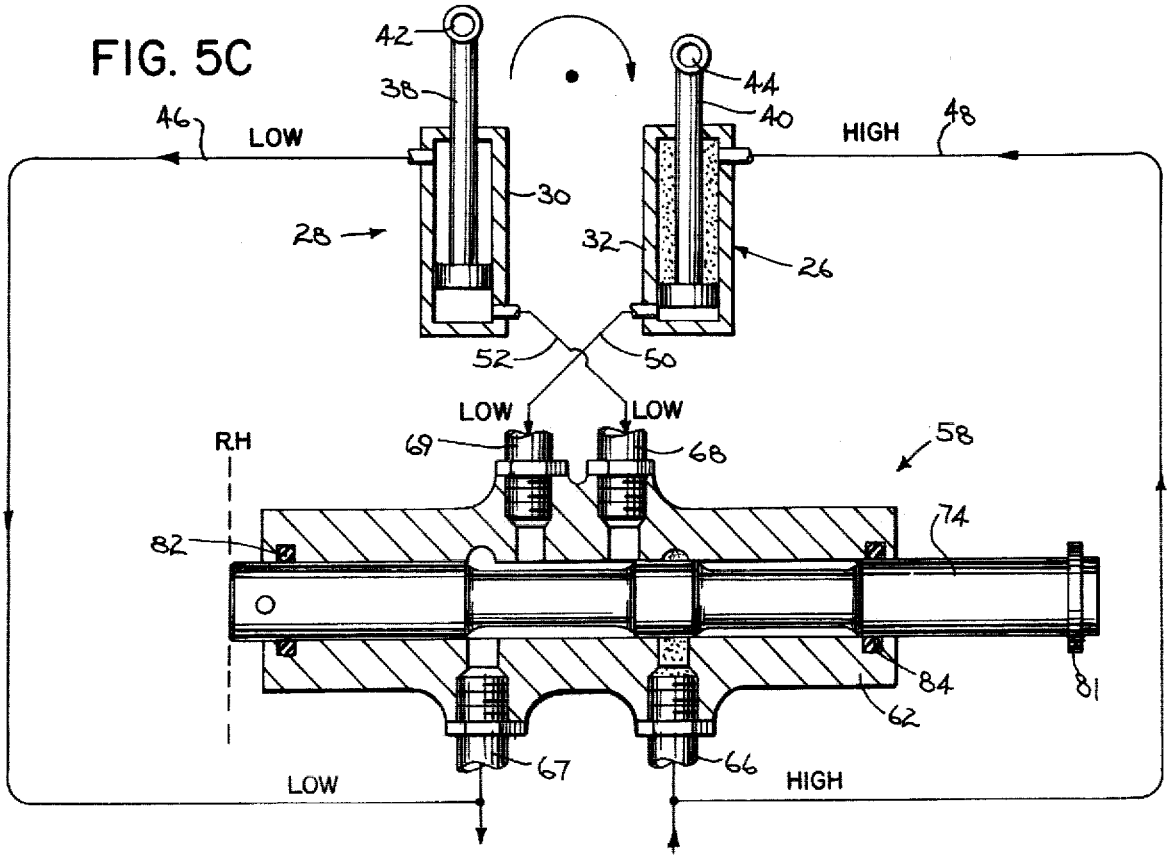

Once the swing tower 22 is rotated clockwise to the position where the right-hand hydraulic motor 26 passes over its overcenter position (see FIG. 6B), the sequencing valve 58 is shifted to its center position (see FIG. 5B). When the sequencing valve shifts from the left-hand position L.H. to the center position C, high pressure fluid is cut off from the cylinder side of the right-hand hydraulic motor 26 and the cylinder side is ported to the reservoir 56. With hydraulic fluid thus ported, the right-hand hydraulic motor develops its maximum output force in that the maximum pressure differential is developed across its piston. This drives the piston rod 40 of the right-hand hydraulic motor 26 inwardly. Since the porting of fluid to the left-hand hydraulic motor 28 has not changed the right-hand hydraulic motor 26 cooperates with the left-hand hydraulic motor to rotate the swing tower 22 clockwise. The sequencing valve 58 remains in its center position C until the swing tower 22 has rotated so far to the right where the left-hand hydraulic motor 28 passes through its overcenter position (see center line 72 of FIG. 6C).

When the sequencing valve 58 shifts from the center position C to the right-hand R.H. position, the flow control ports are arranged as illustrated in FIG. 5C. In shifting from the center position C to the right-hand position R.H., high pressure fluid was cut off from the cylinder side of the left-hand hydraulic motor 28. This isolates the left-hand hydraulic motor 28 from high pressure fluid. Since the flow of fluid has not been changed to the right-hand hydraulic motor 26, the swing tower 22 continues to rotate clockwise without the left-hand hydraulic motor 28 opposing the rotation as would be the case had not the sequencing valve 58 been employed. The swing tower 22 continues to rotate clockwise until either the swing tower reaches its mechanical stops or the piston of the right-hand hydraulic motor 26 bottoms in its cylinder 32 whereupon the boom 20 has been rotated to its extreme right-hand position. It will be noted that the position of the components illustrated in FIG. 5C is the same as the position of the components illustrated in FIG. 4A with the exception that the flow of fluid has been reversed.

It should be observed from the foregoing that the sequencing valve 58 is extremely simple in construction and does not require complex machining or otherwise high tolerance hydraulic components. Furthermore, since the flow control valve 60 and the two hydraulic motors 26 and 28 are normally employed in the operation of a backhoe, the sequencing valve 58 can be added to an existing hydraulic circuit with a minimum amount of difficulty and without extensive changes to the conduit and hydraulic hoses joining together the various components. The fact that the torque characteristic curve of the swing control mechanism has been improved with such a relatively minor modification should prove to enhance its acceptance by the industry and lead its employment in swing mechanisms on both backhoes and other articulated vehicles.

Those skilled in the art will appreciate from the foregoing description that the hydraulic circuit just described offers many advantages over hydraulic circuits now in use. Specifically:

(1) The torque characteristic curve is smoother and flatter. In other words, there is less variation from the maximum applied torque to the minimum applied torque;

(2) More torque is available to rotate the swing tower at either end of the arc of rotation;

(3) Relatively speaking, the angular velocity of the boom is slower at the two extreme ends of rotation. This makes cushioning easier and reduces the impact of the swing tower or the boom running into the mechanical stops;

(4) No flow restrictors are required to slow the swing of the boom;

(5) The absence of flow restrictors and the simplified design of the sequencing valve results in a lower heat input to the hydraulic system thus reducing the load on the hydraulic cooler;

(6) Since the negative torque contribution at either end of the swing is eliminated, more torque is available at either end to give a quicker start, that is, there is less hesitation in driving the boom from one extreme to the other;

(7) Because the torque output at the two extreme ends of the swing is increased over prior designs, the boom can be more easily swung in an uphill direction when the tractor is inclined at an angle or tilted relative to a horizontal plane;

(8) Because the torque output of the two hydraulic cylinders is relatively flat and stable, end mounted hydraulic motors (see FIG. 1) become more practicable and easier to employ in the design of material handling implements;

(9) The cost of the hydraulic circuit is much less than other known designs; and

(10) A single sequencing valve is used to control the flow to both hydraulic motors.

Thus, it is apparent that there has been provided in accordance with this invention a novel device for controlling the rotation of the swing mechanism of a backhoe or other similar machines. While the invention has been described with respect to one specific embodiment, it should be appreciated that the principles of the invention can be applied to many other devices employing hydraulic motors to convert rectilinear motion to a rotation. Once the basic principle of the invention is understood, it will be realized that there are many alternatives, modifications and variations that will be apparent to those skilled in the art in light of the foregoing description. Accordingly, it is intended to cover all alternatives, modifications, and variations as set forth within the spirit and broad scope of the following claims.

What is claimed is as follows:

1. In an implement having a support stand attached to a tractor having a hydraulic system, and a swing tower pivotally connected to said support stand about a vertical axis and supporting a boom, apparatus for rotating said boom laterally from one side to the other side of said tractor, comprising:

(a) two hydraulic motors pivotally interconnected between the support stand and the swing tower, each of said motors having a cylinder end and a piston rod end, the cylinder ends being pivotally connected to said support stand and the piston rod ends pivotally connected to the swing tower by a pivotal connection parallel to and spaced from the pivotal connection of the swing tower to the support stand, the rectilinear expansion and contraction of said motors inducing rotational movement to said swing tower about its pivotal axis on the support stand;

(b) a source of fluid pressure;

(c) a drain reservoir;

(d) directional flow control means for selectively delivering a flow of fluid under pressure from the source of fluid pressure to the piston rod end of one of said two hydraulic motors and for connecting the piston rod end of the other hydraulic motor to the drain reservoir; and (e) sequencing valve means operationally associated with the rotational position of said swing tower, for sequentially connecting both of said cylinder ends to the source of fluid pressure; then connecting the cylinder end of said one hydraulic motor to the drain reservoir while connecting the cylinder end of the other hydraulic motor to the source of fluid pressure; and then connecting both of said cylinder ends to the drain reservoir, whereby said boom is rotated by: first by the other of said two hydraulic motors developing its maximum output force while said one hydraulic motor develops a reduced output force; then by both of said two hydraulic motors; and then by said one hydraulic motor with the other of said two hydraulic motors isolated from high pressure fluid.

2. The apparatus as set forth in claim 1, wherein said sequencing valve means includes:

(a) a valve housing carried by said support stand and having a central bore passing therethrough;

(b) a valve spool operatively connected to each of said two hydraulic motors and disposed within the bore of said valve housing for axial movement therein, said spool and said valve housing cooperating to control the flow of fluid under pressure to and from the cylinder ends of said two hydraulic motors; and (c) sequencing means, connected to said spool and operationally associated with said swing tower, for positioning said spool to control the flow of fluid to and from the cylinder ends of said two hydraulic motors.

3. The apparatus as set forth in claim 2, wherein said valve housing has four flow ports: two of which are in flow communication with the piston rod ends of said two hydraulic motors; and two of which are in flow communication with the cylinder ends of said two hydraulic motors.

4. The apparatus as set forth in claim 3, wherein said valve spool has a central land separating two recessed portions.

5. The apparatus as set forth in claim 1, wherein said sequencing valve means shifts position first when the piston rod of the one hydraulic motors crosses the pivotal connection between the swing tower and the support stand, and then when the piston rod of said other hydraulic motor crosses said pivotal connection.

6. In an implement having a fixed member attached to a tractor and a pivoting member that is pivotally connected to said fixed member for rotational movement about a vertical axis, apparatus for rotating said pivoting member about said vertical axis, comprising:

(a) at least two hydraulic motors pivotally interconnected between said fixed member and said pivoting member to rotate said pivoting member relative to said fixed member, each of said hydraulic motors having an over-center position defined as that position where the center line of the axis of the hydraulic motor crosses the vertical pivot axis of said pivoting member; and (b) fluid circuit means connected to said two hydraulic motors for delivering hydraulic fluid under pressure and for draining hydraulic fluid to actuate said hydraulic motors to rotate said pivoting member about said vertical axis, said fluid circuit means including means for directing hydraulic fluid under pressure to one end of one hydraulic motor and means for draining one end of the other hydraulic motor, said fluid circuit means also including sequencing valve means operationally associated with said pivoting member for sequentially directing hydraulic fluid under pressure to the other ends of both hydraulic motors; then directing hydraulid fluid under pressure to the other end of the other hydraulic motor while draining the other end of said one hydraulic motor; and then draining the other ends of both hydraulic motors in rotating said pivoting member from one extreme position to another, said sequencing valve means shifting position at the over-center position of said two hydraulic motors as said pivoting member rotates from one extreme position to the other.

7. The apparatus as set forth in claim 6, wherein said sequencing valve means includes a spool valve having first, second, and third positions and first, second, third and fourth flow control ports, each port being in fluid communication with one of the four ends of said two hydraulic motors.

8. The apparatus as set forth in claim 7, wherein:

(a) the first port, the second port and the third port are in fluid communication with each other when said spool is in said first position;

(b) the first port is in fluid communication with the second port and the third port is in fluid communication with the fourth port when said spool is in said second position; and (c) the second port, the third port, and the fourth port are in fluid communication with each other when said spool is in said third position, whereby in each position of said spool at least two valve ports are joined together.

9. The apparatus as set forth in claim 8, wherein said first and third ports are in fluid communication with opposite ends of one hydraulic motor and said second and fourth ports are in fluid communication with opposite ends of the other hydraulic motor, whereby both hydraulic motors are actuated by applying pressure to only one of their ends when said spool is in said second position.

* * * * *